US005246570A

United States Patent [19]

Cronauer et al.

[11] Patent Number: 5,246,570

[45] Date of Patent: Sep. 21, 1993

[54] COAL LIQUEFACTION PROCESS USING SOLUBLE MOLYBDENUM-CONTAINING ORGANOPHOSPHORODITHIOATE CATALYST

[75] Inventors: Donald C. Cronauer, Naperville; April J. Swanson, Berkeley; Joseph T. Joseph, Naperville; Arunabha Basu, Naperville; Simon G. Kukes, Naperville, all of Ill.

[73] Assignee: Amoco Corporation, Chicago, Ill.

[21] Appl. No.: 865,837

[22] Filed: Apr. 9, 1992

[51] Int. Cl.[5] ..... C10G 1/06; C10G 1/08

[52] U.S. Cl. ..... 208/421; 208/412; 208/413; 208/420

[58] Field of Search ..... 208/412, 413, 420, 421

[56] References Cited

U.S. PATENT DOCUMENTS

| | | | |
|---|---|---|---|
| 4,077,867 | 3/1978 | Aldridge et al. | 208/418 |
| 4,325,800 | 4/1982 | Rosenthal et al. | 208/413 |
| 4,325,801 | 4/1982 | Kuehler | 208/413 |
| 4,331,531 | 5/1982 | Kuehler | 208/412 |
| 4,347,116 | 8/1982 | Whitehurst et al. | 208/416 |
| 4,358,359 | 11/1982 | Rosenthal et al. | 208/413 |
| 4,379,744 | 4/1983 | Rosenthal et al. | 208/413 |
| 4,485,008 | 11/1984 | Maa et al. | 208/412 |
| 5,026,475 | 6/1991 | Stuntz et al. | 208/403 |
| 5,055,174 | 10/1991 | Howell et al. | 208/112 |

FOREIGN PATENT DOCUMENTS

| | | | |
|---|---|---|---|
| 1249536 | 1/1989 | Canada | 196/10 |

*Primary Examiner*—Theodore Morris
*Assistant Examiner*—Walter D. Griffin
*Attorney, Agent, or Firm*—Scott P. McDonald; Richard A. Kretchmer; Frank J. Sroka

[57] ABSTRACT

A coal liquefaction process employing a first stage liquefaction step catalyzed by a soluble molybdenum-containing organophosphorodithioate catalyst is disclosed. In some embodiments, two consecutive liquefaction steps employ a molybdenum-containing organophosphorodithioate catalyst operating at a relatively high liquefaction temperature. In other embodiments, a second liquefaction process step operating at a relatively low temperature employs a hydrocracking catalyst to upgrade materials obtained from the first soluble catalyst liquefaction step. In some embodiments, an interstage gas separator removes gases such as carbon dioxide produced in the first liquefaction step from a partially liquefied mixture prior to further liquefying the mixture in the second liquefaction step.

20 Claims, 2 Drawing Sheets

COAL LIQUEFACTION PROCESS USING SOLUBLE MOLYBDENUM-CONTAINING ORGANOPHOSPHORODITHIOATE CATALYST

FIELD OF THE INVENTION

The invention relates to processes for coal liquefaction. More particularly, the invention relates to coal liquefaction processes which employ a soluble molybdenum-containing organophosphorodithioate catalyst to promote the initial molecular degradation of coal.

BACKGROUND OF THE INVENTION

The presence of vast world-wide coal reserves and the continuing need for stable supplies of liquid fuels suggest that coal-derived liquid fuels can play an important role as an energy source. This is particularly true in countries like the United States where transportation infrastructures are heavily oriented toward the transportation of liquid, rather than solid, fuels.

Under appropriate process conditions, coal liquefaction processes can supply a broad variety of liquid fuels ranging from heavy boiler fuels to gasolines. Additionally, many coal-derived liquids are useful as chemical feedstocks. For these reasons, liquid fuel producers and refiners continue to search for improved coal liquefaction processes as well as catalysts useful for improving the yield and quality of liquid product produced by these processes.

Early catalytic coal liquefaction processes such as the Bergius process tended to be complex multistep processes which were considered to be economically unfavorable. For example, the Bergius process required that coal was first mixed with a catalyst and then hydrogenated in a liquid phase in a slurry of heavy recycle oil. Liquid products were then distilled from the mixture and hydrogenated in a vapor phase over a solid catalyst. As noted by Nowacki in Coal Liquefaction Processes, Noyes Data Corp. 1979 page 19, principal disadvantages of this process included the need for high system pressures ranging up to 10,000 pounds as well as the need for the vapor phase hydrogenation.

Modern catalytic liquefaction processes have improved on the early Bergius process by reacting a slurry of coal and oil over a supported hydrogenation or hydrocracking catalyst in one or more stages of a multistage process. For example, U.S. Pat. No. 4,358,359 to Rosenthal discloses a two stage liquefaction process in which coal is first liquefied in a process-derived solvent and hydrogen in the absence of a catalyst. The coal and solvent mixture is then transferred to a hydrocracking reactor and hydrocracked in the presence of a supported hydrocracking catalyst. Other similar processes having a catalyst-free first liquefaction step and one or more subsequent supported catalyst hydrogenation or hydrocracking steps include U.S. Pat. Nos. 4,331,531, 4,317,446, 4,325,800, and 4,325,801.

While the processes noted above purportedly avoid many of the difficulties inherent in early liquefaction processes, such as the Bergius process, these processes are subject to other disadvantages inherent in many supported catalyst coal liquefaction systems. Most significantly, these type systems have been known to suffer from rapid deactivation of the supported catalysts, therefore requiring frequent catalyst regeneration and/or replacement or the use of upstream guard beds such as those disclosed in U.S. Pat. No. 4,325,800. Other disadvantages often associated with supported catalyst coal liquefaction processes include the agglomeration of small catalyst particles into larger, relatively less active catalyst species and poor conversion stemming from irregular catalyst dispersion within the liquefaction reactor. Additionally, such systems typically use ebullated bed reactors which are expensive to build and operate and must be operated under the narrow range of operating conditions required to provide proper ebullation of the coal, solvent and catalyst reaction mixture.

The solid catalyst-related problems noted above have led others to employ dispersed or soluble catalysts in coal liquefaction processes. Canadian Patent No. 1 249 536 discloses a single stage catalytic liquefaction process employing dihydrocarbyl-substituted dithiocarbamates of various metals as soluble catalyst precursors. The liquid catalyst precursor is converted to an active catalyst heating a mixture of coal, solvent and precursor as the mixture enters a reaction zone and reacts to produce a liquefied mixture. The liquified product is then fractionated by distillation or other means. As disclosed in that patent, the process produces relatively low liquid yields of less than about forty-two percent of the moisture free weight of the feed coal.

Others have attempted to minimize the difficulties associated with supported catalyst operation in coal liquefaction processes by operating a dispersed catalyst reactor upstream of a supported catalyst hydrocracking reactor. For example, U.S. Pat. No. 4,379,744 discloses the use of dispersed first stage liquefaction catalysts such as water-soluble salts of catalytic metals or oil soluble compounds containing catalytic metals such as napthenates of molybdenum, chromium or vanadium or phosphomolybdic acid. In this process, effluent from a first dispersed catalyst liquefaction step is transferred to a second process step in which the transferred effluent is hydrogenated in the presence of the hydrocracking catalyst. This process may be undesirable as it appears that carbon oxides evolved from coal dissolution are not removed prior to the hydrogenation step, thereby needlessly consuming hydrogen when these oxides are converted to methane.

While the dispersed catalyst liquefaction processes disclosed above suggest that dispersed catalysts may be useful in the first stage of a multistage coal liquefaction process, a need exists for improved dispersed catalyst processes. Such improved processes preferably should maximize yields of lighter, more valuable liquid products while minimizing the formation of heavier, less valuable products such as resid. It is also preferred that the processes avoid the needless hydrogenation of carbon dioxide. Additionally, it is preferred that the processes either avoid the use of supported catalysts or be carried out under conditions that minimize the supported catalyst problems discussed above.

SUMMARY OF THE INVENTION

It is an object of the invention to provide an improved coal liquefaction process.

It is a general object of the invention to provide a process for coal liquefaction which employs a new soluble molybdenum-containing organophosphorodithioate catalyst in an initial coal liquefaction step to provide high liquefaction yields.

In a second aspect of the invention it is a further object of the invention to provide a coal liquefaction process which employs a new soluble molybdenum-containing organophosphorodithioate first-stage liquefaction catalyst and a second stage supported hydrocracking catalyst.

In a third aspect of the invention, it is an object of the invention to provide a multi-stage coal liquefaction process employing a new soluble molybdenum-containing organophosphorodithioate liquefaction catalyst in at least two consecutive relatively high temperature reactor stages.

The general object of the invention can be accomplished by providing a coal liquefaction process which reacts coal, a cool solvent and a soluble molybdenum-containing organophosphorodithioate catalyst in a first stage reactor under liquefaction conditions to produce a liquefied reaction mixture.

In the second aspect of the invention, the use of a soluble molybdenum-containing organophosphorodithioate catalyst in a relatively high temperature first reactor stage provides for sufficient coal dissolution to permit a subsequent hydrocracking reactor stage to operate successfully at a relatively low liquefaction temperature, thereby minimizing supported catalyst fouling and gas production while providing high system liquefaction yields.

In the third aspect of the invention, providing two or more relatively high temperature soluble catalyst reactor stages in series provides relatively high liquefaction yields without the need for supported catalysts.

As demonstrated by several of the examples herein, employing a soluble molybdenum-containing organophosphorodithioate catalyst in a first reactor stage provides coal liquefaction performance superior to other soluble molybdenum-containing catalysts such as molybdenum napthenates and molybdenum carbamates. Additionally, the use of a soluble molybdenum-containing organophosphorodithioate catalyst in a first reactor stage permits that stage to operate at relatively high liquefaction temperatures, thereby providing for higher first stage yields of coal-derived liquids.

As used herein, the term organophosphorodithioate catalyst refers generically to molybdenum, oxymolybdenum and sulfurized oxymolybdenum compounds containing one or more organophosphorodithioate groups as disclosed below.

As used herein, coal liquefaction conditions refer to reactor operating conditions between 700° and 900° F. at pressures between 500 and 5000 psig with inlet partial hydrogen pressures greater than about 85 percent of total system pressure.

As used herein, the term coal refers to all bituminous, sub-bituminous and lignitic coals.

DETAILED DESCRIPTION OF THE INVENTION

Each of the following coal liquefaction processes employs a soluble molybdenum-containing organophosphorodithioate catalyst in a first stage liquefaction reactor to provide relatively high yields of coal-derived liquid products. As the following discussion and examples illustrate, a first stage use of these catalysts can be advantageously followed by liquid or supported catalyst liquefaction steps to provide relatively high yields of coal-derived liquids. Use of these soluble catalysts also permits one or more liquefaction steps to be carried out in slurry reactors rather than the ebullated bed-type reactors normally used for supported catalyst liquefaction, thereby decreasing reactor cost and providing for easier reactor operation. Additionally, pilot plant experience has shown that these catalysts unexpectedly prohibit the formation of retrogressive liquefaction products known to deposit on the walls of reactors and transfer lines during the liquefaction of low rank coals.

The processes described herein can be advantageously used to liquefy coal of any rank. The process is believed to be particularly advantageous for the liquefaction of low ranked coals that generate significant quantities of carbon oxides during liquefaction.

Soluble organophosphorodithioate catalysts useful in these processes generically include molybdenum, oxymolybdenum and sulfurized oxymolybdenum compounds containing one or more organophosphorodithioate groups. Preferred catalysts in this genus include:

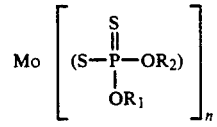

wherein n=3,4,5,6; $R_1$ and $R_2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or where $R_1$ and $R_2$ are combined in one alkylene group of the structure

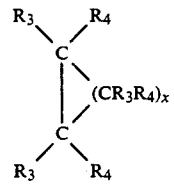

with $R_3$ and $R_4$ being independently selected from H, alkyl, cycloalkyl, alkylcycloalkyl and aryl, alkylaryl and cycloalkylaryl groups as defined above, and x ranging from 1 to 10;

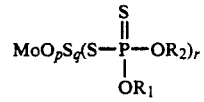

wherein p=0,1,2; q=0,1,2; (p+q)=1,2;

r=1,2,3,4 for (p+q)=1 r=1,2 for (p+q)=2; and

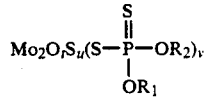

wherein t=0,1,2,3,4; u=0,1,2,3,4;

(t+u)=1,2,3,4 v=4,6,8,10 for (t+u)=1; v=2,4,6,8 for (t+u)=2;

v=2,4,6 for (t+u)=3, v=2,4 for (t+u)4.

Of these preferred compounds, the sulfurized oxymolybdenum catalysts are most preferred. Groups $R_1$ through $R_4$ generally should be selected to provide for catalyst solubility in the coal-solvent feed slurry, with $R_1$ and $R_2$ alkyl groups of 6 to 12 carbon atoms being preferred.

Figure 1:
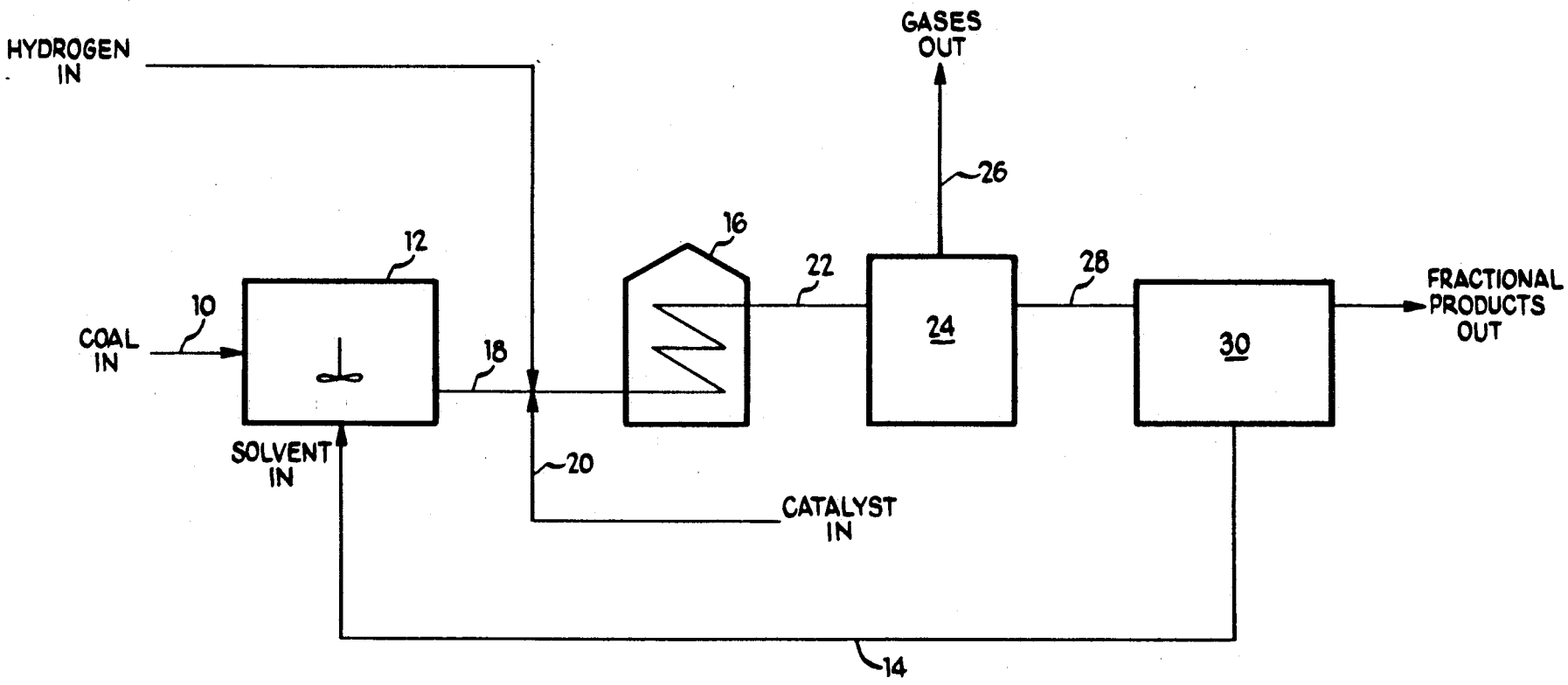
FIG. 1 is a flow diagram of a single stage coal liquefaction process in accordance with the present invention.

FIG. 1 is a single stage coal liquefaction process flow diagram in accordance with the present invention. In this embodiment, coal crushed to less than 100 mesh (U.S. Standard) is introduced through a feedstock transfer line 10 into a slurry mix tank 12. Concurrently, a process-derived liquefaction solvent as described below is introduced into mixer 12 through solvent recycle line 14. Typically, the coal to solvent ratio within mix tank 12 should be at least 1 part solvent for each part coal by weight, with 1 to 4 parts solvent per part coal being preferred. The coal and solvent are slurried together at a temperature between about 100 and 400 degrees Fahrenheit within mixer 12 and transferred toward a preheater 16 through a slurry transfer line 18.

A soluble catalyst injection line 20 is connected to slurry transfer line 18 at a point immediately upstream of preheater 16. A soluble molybdenum organophosphorodithioate catalyst is introduced through line 20 into the coal solvent slurry. It is preferred that line 20 be connected immediately upstream of preheater 16 as shown to prevent the catalyst from decomposing into less dispersable forms within mixer 12 or in transfer line 18. It is also preferred that the catalyst be added no later than the inlet to preheater 16 as it is believed to be important that the catalyst be in the presence of the coal before dissolution of the coal begins.

As the catalyst, coal and solvent mixture passes through preheater 16, the mixture should be rapidly heated to a temperature of between about 600 and 750 degrees Fahrenheit. The heated mixture then flows from preheater 16 through reactor inlet line 22 into liquefaction reactor 24. Concurrently, hydrogen is introduced into transfer line 18 upstream of preheater 16, preferably at the inlet of preheater 16 so that the slurry, catalyst and hydrogen are effectively mixed together immediately before entering preheater 16. If required to ensure good mixing, an additional mixing device should be employed immediately upstream of the preheater inlet.

Liquefaction reactor 24 is operated under the following coal liquefaction conditions. Reactor operating temperatures can range from about 700 to 900 degrees Fahrenheit, with the preferred range for organophosphorodithioate-catalyzed reactions ranging from 750° to 850° F. Total system pressure can range from about 500 to 5000 psig, with the preferred system pressure ranging between about 1000 and 3000 psig, with hydrogen partial pressure of the feed gas stream typically comprising 85 percent or more of the system pressure. Liquefaction residence times can range from 10 to 240 minutes, with the preferred range being from 15 to 60 minutes.

Gaseous products evolved from the liquefaction process can be withdrawn from reactor 24 through gaseous discharge line 26. Reaction products removed through this line include hydrogen sulfide, water, carbon monoxide, carbon dioxide, ammonia and $C_1$ through $C_4$ hydrocarbons as well as unreacted hydrogen.

The liquefied mixture from reactor 24 passes through a reactor discharge line 28 into a fractionator 30 for further processing as is well known in the art. Typically, fractionator 30 may be an atmospheric or vacuum distillation apparatus alone or in combination with a multistage deasphalting unit. A portion of one or more of the heavier fractions separated by fractionator 30 are recycled through recycle line 14 to mix tank 12. A useful combination of fractions for use as the solvent is about 50 percent 650–1000 degree Fahrenheit boiling liquids (atmospheric pressure) and about 50 percent 1000 degree plus Fahrenheit boiling liquids.

SINGLE STAGE REACTOR EXAMPLES

The relative effectiveness of sulfurized oxymolybdenum phosphorodithioate catalysts is illustrated by the following examples. In these examples, commercially available solutions of various organomolybdenum solutions have been tested under coal liquefaction conditions to determine the yields of tetrahydrofuran-soluble, toluene-soluble and hexane soluble products.

The tested product known as Molyvan L was purchased from the R. T. Vanderbilt Chemical Co., Inc. of Norwalk, Conn. and is a heavy oil solution of a sulfurized oxymolybdenum organophosphorodithioate having the structure:

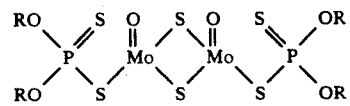

or a similar structure in which the sulfur and oxygen atoms bonded to the molybdenum atoms are interchanged as shown in the Molyvan 807 structure below.

Molyvan L contains approximately eight percent molybdenum by weight and is representative of the preferred catalysts described above.

The tested products known as Molyvan 807 and Molyvan 822 also were purchased from Vanderbilt. Both products contain a molybdenum oxysulfide dithiocarbamate believed to have the structure:

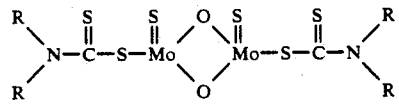

Molyvan 807 and 822 are believed to contain about 4.9 percent molybdenum by weight and are believed to be representative of molybdenum dithiocarbamate catalysts of the type disclosed in Canadian Patent No. 1 249 536.

Molybdenum octoate is a molybdenum napthenate purchased commercially and having the structure:

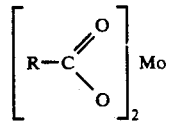

where R—C is a two ethyl hexyl group. This compound contains about 8 per cent molybdenum by weight.

In each example, one or more of the foregoing catalysts were tested at temperatures of 750, 800, 825 or 840 degrees Fahrenheit in a 300 cc continuous flow reactor at a pressure of about 200 psig under the operating conditions summarized in Tables 2–5. In each case, Black Thunder coal having the characteristics listed in Table 1 was ground to pass through a 100 mesh screen and mixed with a 650°-1000° F. coal-derived solvent and the soluble catalyst prior to being introduced into the test reactor. The comparative effectiveness of the catalysts are summarized in Tables 2 through 5. In each case, the catalyst concentration is expressed as ppm of molybdenum per part of original coal charge.

As the composite testing results in Examples 3, 4 and 5 illustrate, the Molyvan L sulfided oxymolybdenum organophosphorodithioate catalyst produced surprisingly superior liquefaction results at temperatures of 800°, 825° and 840° F.

TABLE 1

| COAL ANALYSES | |
|---|---|
| COAL | BLACK THUNDER |
| As Received, Wt % $H_2O$ | 23.6 |
| Ultimate Analysis, Dry, Wt. % | |
| C | 69.60 |
| H | 5.01 |
| N | 1.07 |
| S | 0.46 |
| O (By Difference) | 17.14 |
| Ash | 6.72 |

EXAMPLE 1

In this example, a MolyvaN 822 and Molyvan L were tested at a temperature of 750 degrees Fahrenheit. As can be seen in Table 2, both catalysts produced slightly higher THF-soluble, toluene-soluble and hexane-soluble yields than did the catalyst-free control runs. Additionally, it should be noted that Molyvan L produced slightly higher THF-soluble and hexane-soluble yields than did the Molyvan 822 dithiocarbamate catalyst.

TABLE 2

| Catalyst | None | None | Molyvan L | Molyvan 822 |
|---|---|---|---|---|
| Catalyst Concentration (ppm) | 0 | 0 | 1000 | 100 |
| Reactor Temperature (°F.) | 750 | 750 | 750 | 750 |
| Slurry Feed Rate (lb/hr) | 719.6 | 528.0 | 625.5 | 774.9 |
| Coal Feed Rate (lb/hr) | 168.0 | 123.2 | 144.2 | 184.8 |
| Space Time (min) | 22.8 | 31.0 | 26.2 | 21.1 |
| THF Soluble Yield (% MAF Coal) | 55.2 | 52.5 | 57.9 | 56.0 |
| Toluene Soluble Yield (% MAF Coal) | 44.7 | 38.9 | 46.7 | 46.5 |
| Hexane Soluble Yield (% MAF Coal) | 21.4 | 11.9 | 19.8 | 18.3 |
| CO, $CO_2$ (% MAF Coal) | 1.75 | 3.72 | 1.59 | 2.33 |
| $C_1$-$C_3$ (% MAF Coal) | 0.51 | 1.17 | 0.45 | 0.52 |

EXAMPLE 2

In this example, Molyvan 822, Molyvan 807 and Molyvan L were tested at a temperature of 800 degrees Fahrenheit. As can be seen in Table 3, each catalyst produced higher THF-soluble, toluene-soluble and hexane-soluble yields than did the catalyst-free control runs. Additionally, it should be noted that Molyvan L produced THF-soluble, toluene-soluble and hexane-soluble yields about 6 to 12 percent higher than did the Molyvan 807 and 822 dithiocarbamate catalysts.

TABLE 3

| Catalyst | None | None | Molyvan L | Molyvan 822 | Molyvan 822 | Molyvan 807 |
|---|---|---|---|---|---|---|
| Catalyst Concentration (ppm) | 0 | 0 | 1000 | 100 | 200 | 100 |
| Reactor Temperature (°F.) | 800 | 800 | 800 | 800 | 800 | 800 |
| Slurry Feed Rate (lb/hr) | 701.6 | 542.3 | 632.4 | 782.5 | 857.8 | 654.2 |
| Coal Feed Rate (lb/hr) | 163.8 | 126.6 | 145.8 | 186.6 | 204.6 | 152.7 |
| Space Time (min) | 23.3 | 30.2 | 25.9 | 20.9 | 19.1 | 25.0 |
| THF Soluble Yield (% MAF Coal) | 63.1 | 69.3 | 73.4 | 66.6 | 62.8 | 61.7 |
| Toluene Soluble Yield (% MAF Coal) | 52.9 | 62.1 | 66.9 | 58.9 | 54.5 | 54.5 |
| Hexane Soluble Yield (% MAF Coal) | 13.0 | 18.5 | 28.4 | 21.7 | 17.1 | 0.8 |
| CO, $CO_2$ (% MAF Coal) | 3.21 | 4.14 | 2.55 | 2.66 | 3.00 | — |
| $C_1$-$C_3$ (% MAF Coal) | 2.20 | 3.38 | 1.75 | 1.75 | 1.57 | — |

EXAMPLE 3

In this example, molybdenum octoate and Molyvan L were tested at a temperature of 825 degrees Fahrenheit. As can be seen in Table 4, both catalysts produced higher THF-soluble, toluene-soluble and hexane-soluble yields than did the catalyst-free control run. Additionally, it should be noted that Molyvan L produced 7 to 12 percent higher THF-soluble and toluene-soluble yields than did the molybdenum napthenate catalyst. It also should be noted that the calculated negative hexane-soluble molybdenum octoate yield results from high temperature solvent polymerization contributing sufficient product to this fraction to cause its weight to exceed that of the original coal charge.

TABLE 4

| Catalyst | None | Molyvan L | Molybdenum Octoate |
|---|---|---|---|
| Catalyst Concentration (ppm) | 0 | 1000 | 1000 |
| Reactor Temperature (°F.) | 825 | 825 | 825 |
| Slurry Feed Rate (lb/hr) | 530.4 | 543.6 | 551.9 |
| Coal Feed Rate (lb/hr) | 122.5 | 124.7 | 127.0 |
| Space Time (min) | 30.9 | 30.9 | 29.7 |
| THF Soluble Yield (% MAF Coal) | 72.9 | 80.3 | 73.4 |
| Toluene Soluble | 63.4 | 73.8 | 61.9 |

TABLE 4-continued

| Catalyst | None | Molyvan L | Molybdenum Octoate |
|---|---|---|---|
| Yield (% MAF Coal) | | | |
| Hexane Soluble | 1.7 | 10.0 | −26.5 |
| Yield (% MAF Coal) | | | |
| CO, $CO_2$ (% MAF Coal) | 4.98 | 5.14 | 4.80 |
| $C_1$-$C_3$ (% MAF Coal) | 6.09 | 5.83 | 5.43 |

EXAMPLE 4

In this example, molybdenum octoate and Molyvan L were tested at a temperature of 840 degrees Fahrenheit. As can be seen in Table 5, both catalysts produced higher THF-soluble, toluene-soluble and hexane-soluble yields than did the catalyst-free control run. Additionally, it should be noted that Molyvan L produced 5 to 8 percent higher THF-soluble and toluene-soluble yields than did the molybdenum napthenate catalyst. It again should be noted that the calculated negative hexane-soluble molybdenum octoate yield results from high temperature solvent polymerization contributing sufficient product to this fraction to cause its weight to exceed that of the original coal charge.

TABLE 5

| Catalyst | None | Molyvan L | Molybdenum Octoate |
|---|---|---|---|
| Catalyst Concentration (ppm) | 0 | 1000 | 1000 |
| Reactor Temperature (°F.) | 840 | 840 | 840 |
| Slurry Feed Rate (lb/hr) | 507.9 | 584.1 | 541.4 |
| Coal Feed Rate (lb/hr) | 117.3 | 134.0 | 124.6 |
| Space Time (min) | 32.2 | 28.0 | 30.3 |
| THF Soluble Yield (% MAF Coal) | 72.9 | 81.2 | 76.8 |
| Toluene Soluble Yield (% MAF Coal) | 66.4 | 74.9 | 66.8 |
| Hexane Soluble Yield (% MAF Coal) | −42.9 | 19.2 | −28.5 |
| CO, $CO_2$ (% MAF Coal) | 5.71 | 5.54 | 5.43 |
| $C_1$-$C_3$ (% MAF Coal) | 9.24 | 7.72 | 8.60 |

The foregoing examples illustrate that the sulfurized oxymolybdenum organophosphorodithioate catalyst Molyvan L produces generally higher liquid product yields than the molybdenum dithiocarbamate or molybdenum napthenate catalysts against which it was tested. While not wishing to be bound by any particular theory, it is believed that the superior results may be attributable to the presence of phosphorous in the phosphorodithioate portion of the soluble catalyst molecule. This theory may be supported by x-ray defraction studies of solid catalyst material formed under liquefaction conditions. These studies suggest that the active catalyst species formed by Molyvan L is different from molybdenum disulfide and may contain phosphorous in combination with molybdenum and sulfur.

The benefits of coal liquefaction using soluble molybdenum-containing organophosphorodithioate catalysts is not limited to the single stage reactor systems just described. For example, these catalysts are well suited for use in two stage close-coupled reactor systems of the type illustrated in FIG. 2.

Figure 2:
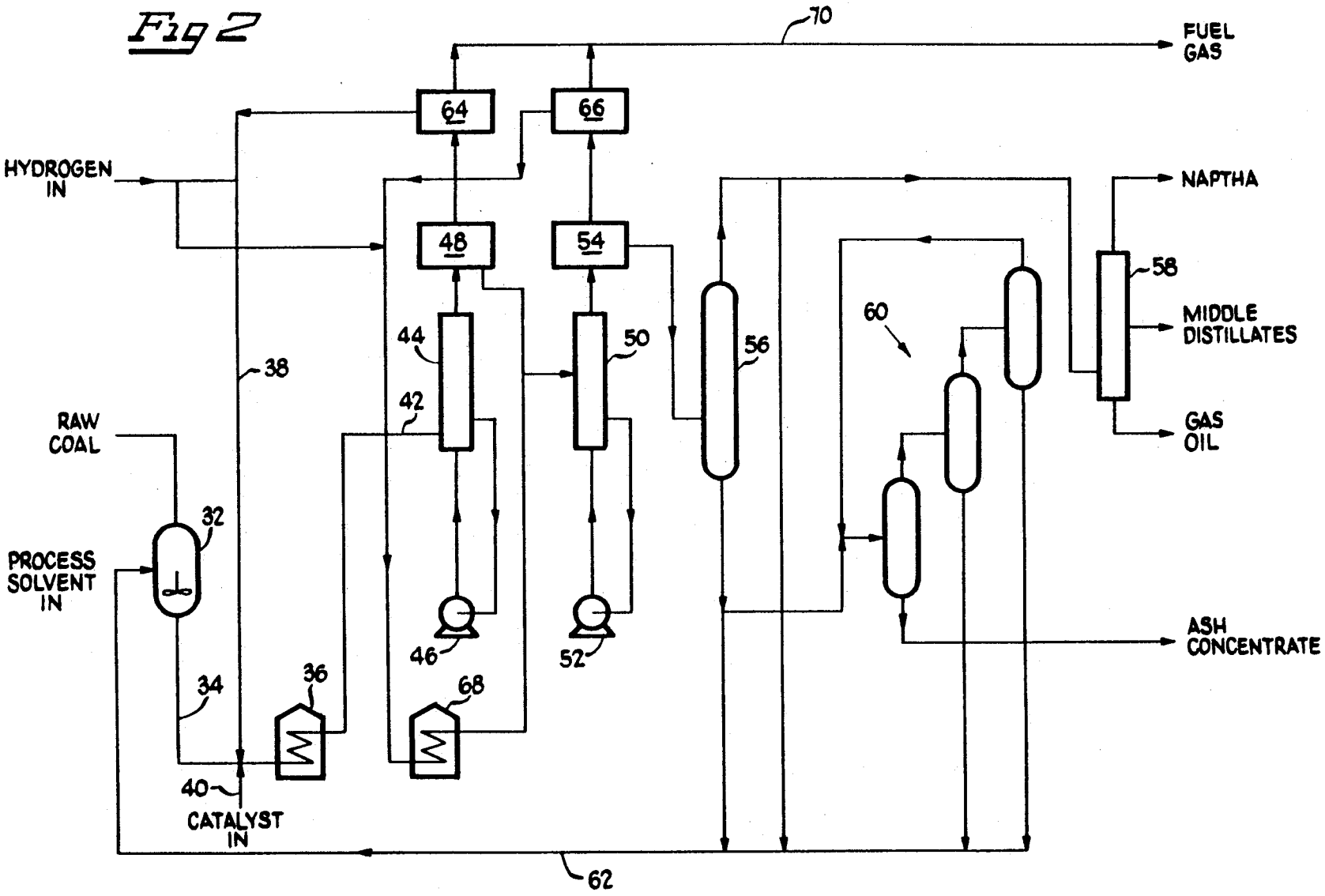
FIG. 2 is a flow diagram of a two stage coal liquefaction process in accordance with the present invention.

Many of the first stage reactor system components illustrated in the two stage reactor system of FIG. 2 are similar to those already described in conjunction with FIG. 1. As in FIG. 1, pulverized raw coal and a process-derived solvent are mixed in a slurry mix tank 32 and passed through a slurry transfer line 34 toward a preheater 36. Hydrogen is introduced into line 34 near the preheater inlet through line 38 while a soluble catalyst is introduced at a point immediately ahead of the preheater inlet through line 40.

Preheated slurry is transferred through line 42 into a first stage liquefaction reactor 44, where the mixture is recirculated by first recirculation pump 46 while it is reacted under coal liquefaction conditions.

Partially liquefied reaction mixture from reactor 44 is passed through an interstage separator 48 to remove carbon dioxide, carbon monoxide, hydrogen sulfide, $C_1$ to $C_4$ hydrocarbons, some light distillates and unreacted hydrogen prior to introducing the partially reacted mixture into a second liquefaction reactor 50. The partially liquefied mixture undergoes additional liquefaction as it is recirculated within second reactor 50 by recirculation pump 52.

Liquefied product from reactor 50 passes through a second separator 54 to remove the gaseous products described earlier and then passes into vacuum flash evaporator 56. Evaporator 56 separates the mixture into a relatively light overhead product stream which can be further fractionated by a distillation unit 58 and into a relatively heavy resid/ash evaporator bottom stream that is further fractionated by a multistage critical solvent deasphalting unit 60.

Various liquid fractions from deasphalting unit 60 as well as some of the flash evaporator bottoms from evaporator 60 are recycled back through solvent recycle line 62 to provide process-derived solvent to slurry mix tank 32.

Hydrogen recycle is provided by passing the gases separated by interstage separators 48 and 54 through gas cleaning systems 64 and 66. Systems 64 and 66 separate hydrogen from the interstage separator effluent and return it to the inlets of first preheater 36 and a second preheater 68, respectively, while other gases separated by systems 64 and 66 leave the reactor system through line 70.

While the close-coupled two stage reactor system illustrated in FIG. 2 can be used with a supported hydrocracking catalyst in each reactor stage, the system also can be run with a soluble catalyst introduced into the first reactor stage and either with or without a supported hydrocracking catalyst in the second stage reactor. The preferred operating conditions for each type of operation vary as discussed below.

When the reactor system of FIG. 2 is run with only soluble catalyst, it is preferred that the system be operated at reactor temperatures between about 800 and 850 degrees Fahrenheit. While these temperatures exceed those commonly used in two-stage catalyst systems having supported catalyst in one or more stages, the use of a soluble organophosphorodithioate catalyst permits effective operation at the more aggressive liquefaction temperatures normally associated with rapid supported catalyst degradation. As the examples below will illustrate, a system run in this manner can produce coal-derived liquid yields equivalent to those from systems using one or two stages of a supported hydrocracking catalyst.

Soluble catalyst system operation also provides considerable economic and operating advantages. These advantages accrue because soluble catalysts do not require the ebullated bed reactors normally used in supported catalyst systems. This permits reactors 44 and 50 to be inexpensive mixed reactors which can operate under less critical conditions than ebullated bed reactors.

Soluble organophosphorodithioate catalysts can also be used to enhance the performance of two-stage reactor systems in which a supported or fixed bed hydrocracking catalyst is used in the second stage reactor. In these systems, the first stage soluble catalyst reactor can be run at aggressive liquefaction temperatures above about 800 degrees Fahrenheit. Because the soluble catalyst provides for good initial liquefaction of the coal, the second stage supported catalyst system can then successfully be run at temperatures below 800 degrees Fahrenheit where supported catalyst fouling is less. Supported catalysts suitable for use in this type of system include most supported hydrocracking and hydrogenation catalysts with those particularly suited for use in petroleum residuum processing being preferred.

The two-stage system just described is particularly suited for use with an interstage separator 48 as shown in FIG. 2. Because carbon oxides evolved from the initial coal liquefaction step are removed prior to entering the second stage hydrogenation reactor, the needless hydrogenation of carbon oxides to methane is avoided. Thus, the interstage separator lowers hydrogen consumption in addition to minimizing methane production.

TWO-STAGE REACTOR EXAMPLES

The benefits of close-coupled two stage coal liquefaction using an organophosphorodithioate catalyst both with and without a supported catalyst second stage are summarized in the examples of Table 8.

In each example, the coal liquefaction runs were conducted in a two stage continuous flow pilot plant having a pair of one liter stirred autoclave reactors connected in series. Each feed slurry consisted of 33 percent by weight of Illinois No. 6 coal having the physical specifications listed in Table 6 and sixty-seven percent by weight of a coal-derived solvent having the characteristics listed in Table 7. Where supported catalyst was used, the catalyst was a nickel-molybdenum resid hydrocracking catalyst deposited on a bimodal alumina support. The supported catalyst was presulfided in 8 percent hydrogen sulfide before use. Where soluble catalysts were used, the catalysts were added to the feed slurry as discussed in conjunction with Examples 1 through 4.

TABLE 6

| COAL ANALYSES | |
|---|---|
| COAL | ILLINOIS NO. 6 |
| As Received, Wt % $H_2O$ | 6.05 |
| Dry, Wt % | |
| C | 69.54 |
| H | 4.56 |
| N | 1.17 |
| S | 3.26 |
| O (By Difference) | 12.03 |
| Ash | 9.44 |
| Fe | 1.19 |
| Na | 0.05 |
| K | 0.18 |
| Ca | 0.37 |
| Mg | 0.06 |
| Al | 0.99 |
| Ti | 0.05 |
| Si | 2.15 |

TABLE 7

| SOLVENT ANALYSES | |
|---|---|
| COAL | ILLINOIS NO. 6 |
| Elemental Analyses, Wt % | |
| C | 89.26 |
| H | 8.83 |
| N | 0.57 |
| S | 0.08 |
| O (By Difference) | 1.26 |
| Distillation, Wt % | |
| IBP-650° F. | 0.36 |
| 650-935° F. | 58.26 |
| 935+° F. | 40.45 |
| Solubility, Wt % | |
| THF Insolubles | 0.12 |
| Toluene Insolubles | 1.07 |
| Hexane Insolubles | 7.96 |

EXAMPLE 5

In Example 5, a control experiment was run using supported catalyst in both stages of the reactor system under the conditions listed in Table 8. It should be noted that the upper temperature of this run was limited to 790 degrees Fahrenheit to simulate operating conditions under which the supported catalyst was believed to have a reasonable operating life.

EXAMPLE 6

In Example 6, Molyvan L soluble catalyst was run in the first stage reactor at 800 degrees while supported catalyst was run in the second stage reactor at 760 degrees. Comparing Examples 5 and 6 shows that conversion decreased slightly while 935° F. plus products (resid) were cut in half.

EXAMPLE 7

Example 7 illustrates the advantage gained by increasing the operating temperature of the Molyvan L catalyzed first stage from 800 degrees to 820 degrees Fahrenheit. This single process change cut resid yields in half while increasing the yield of the more valuable $C_4$ to 935° F. liquids from 56 to 67 percent.

EXAMPLES 8-11

Examples 8, 9, 10 and 11 illustrate the effectiveness of both Molyvan L and molybdenum octoate in two stage soluble catalyst only systems. While the results do not vary to any great degree, Examples 8, 9 and 10 each show that coal liquefaction processes using a Molyvan L catalyzed two stage system in the absence of a second stage supported catalyst can produce conversions of over about 94 percent and $C_4$ to 935° F. liquid yields of about 70 percent. In these examples, product heteroatom content was slightly higher and the hydrogen to carbon ratios were somewhat lower than in those examples using a supported hydrocracking catalyst.

TABLE 8

| | Example | | | | | | |
|---|---|---|---|---|---|---|---|
| | 5 | 6 | 7 | 8 | 9 | 10 | 11 |
| Residence Time, Hours | 3 | 3 | 3 | 3 | 3 | 1.5 | 3 |
| Stage 1, °F. | 790 | 800 | 820 | 800 | 800 | 820 | 800 |
| Stage 2, °F. | 760 | 760 | 760 | 800 | 800 | 820 | 800 |
| Molyvan L concentration as molybdenum ppm of feed coal | 0 | 192 | 192 | 192 | 84 | 84 | 0 |
| Molybdenum | 0 | 0 | 0 | 0 | 0 | 0 | 96 |

TABLE 8-continued

| | Example | | | | | | |
|---|---|---|---|---|---|---|---|
| | 5 | 6 | 7 | 8 | 9 | 10 | 11 |
| octoate concentration as molybdenum ppm of feed coal | | | | | | | |
| Catalyst Age, Hours | 180 | 150 | 310 | — | — | — | — |
| Yields, Wt % of MAF Coal | | | | | | | |
| $C_1$-$C_3$ | 8.9 | 9.3 | 10.1 | 8.5 | 9.1 | 11.0 | 10.5 |
| $C_4$-360° F. | 7 | 7 | 12 | 7 | 10 | 11 | 8 |
| 360-650° F. | 35 | 35 | 43 | 40 | 39 | 41 | 43 |
| 650-935° F. | 5 | 13 | 12 | 21 | 19 | 16 | 22 |
| 935° F.+ | 28 | 15 | 7 | 8 | 8 | 5 | 3 |
| $C_4$-935° F. | 47 | 56 | 67 | 68 | 66 | 68 | 72 |
| Conversion | 93.2 | 91.1 | 93.9 | 94.6 | 96.3 | 95.7 | 94.5 |
| $H_2$ Consumption | 5.6 | 5.4 | 6.1 | 5.1 | 5.7 | 4.9 | 4.8 |

EXAMPLE 12

In Example 12, Black Thunder coal was liquefied using either Molyvan L or Molyvan 822 as a soluble catalyst. The liquefactions were conducted in a two-stage close-coupled liquefaction reactor of the type discussed in conduction with FIG. 2. Detailed operating parameters and liquefaction results for each run are summarized in Table 9.

TABLE 9

| Catalyst | Molyvan L | Molyvan 822 |
|---|---|---|
| Coal | | |
| Feed rate, *MF lb/hr | 260.9 | 263.5 |
| Ash, wt % *MF | 7.1 | 7.1 |
| Conc. in slurry, wt % *MF | 24.5 | 24.8 |
| Process solvent, wt % | | |
| Resid | 44.0 | 44.6 |
| Recycled bottoms from vacuum flash | 20.1 | 19.7 |
| First Stage/Second Stage | | |
| Reactor temperature, °F. | 840/809 | 841/809 |
| Inlet $H_2$ partial pressure, psia | 2724/2546 | 2771/2546 |
| Total gas flow, scfh | 4614/4850 | 4858/5010 |
| Recycle gas, scfh | 1234/3021 | 1616/3094 |
| Yield, wt % MAF coal | | |
| H2 | −5.5 ± 0.2 | −5.1 ± 0.2 |
| Water | 13.2 ± 1.3 | 14.2 ± 1.0 |
| CO, $CO_2$ | 5.7 ± 0.2 | 5.9 ± 0.2 |
| $NH_3$ | 0.3 ± 0.2 | 0.5 ± 0.2 |
| $H_2S$ | 0.4 ± 0.1 | 03. ± 0.1 |
| $C_1$-$C_3$ gas | 9.0 ± 0.3 | 8.9 ± 0.7 |
| $C_4$+ distillate | 60.7 ± 2.0 | 57.0 ± 1.1 |
| $C_4$-$C_6$ | 3.3 ± 0.5 | 3.0 ± 0.6 |
| IBP-350° F. | 8.0 ± 0.6 | 9.3 ± 1.3 |
| 350-450° F. | 10.5 ± 0.7 | 9.7 ± 0.8 |
| 450-EP | 39.0 ± 2.4 | 35.0 ± 1.8 |
| Resid | 2.4 ± 0.8 | 4.1 ± 0.6 |

*Moisture free

As can be seen from comparing the two runs, the Molyvan L-catalyzed run increased the $C_4$+distillate yield from 57 to 60.7 weight percent of the feed coal, a relative increase of $C_4$+yield of about 6.5 percent. Additionally, the Molyvan L-catalyzed run produced approximately 40 percent less resid than did the Molyvan 822 catalyzed run. Thus, as with the earlier single stage reactor examples, Molyvan L produced unexpected improvements in product yield over the Molyvan 822 dithiocarbonate catalyst run.

The foregoing examples illustrate the effectiveness of molybdenum organophosphorodithioate catalysts in both single and multistage coal liquefaction processes. Other processes employing these catalysts not departing from the spirit of the invention will be apparent to those skilled in the art after reviewing the embodiments disclosed herein. The disclosed embodiments, therefore, are to be considered to be exemplary and limited only by the scope of the following claims.

We claim:

1. A coal liquefaction process comprising reacting coal, a coal solvent and a soluble molybdenum organophosphorodithioate catalyst under coal liquefaction conditions to produce a partially liquefied product.

2. The coal liquefaction process of claim 1 wherein the partially liquified product is further liquified in the second liquefaction to produce a further liquified product.

3. The process of claim 2 wherein the second liquefaction is performed in the presence of a supported hydrocracking catalyst.

4. The process of claim 3 wherein an operating temperature for the first liquefaction is greater than 805 degrees Fahrenheit and wherein an operating temperature for the second liquefaction is less than about 795 degrees Fahrenheit.

5. The process of claim 3 wherein the partially liquified product is passed through an interstage separator to separate volatile reaction products.

6. The process of claim 1 wherein the soluble catalyst is a sulfurized oxymolybdenum dialkylphosphorodithioate catalyst.

7. The process of claim 2 wherein a fraction separated from the further liquefied product is used as the coal solvent.

8. The process of claim 1 wherein the coal to molybdenum feed ratio is between 100 to 1 and 100,000 to 1.

9. The process of claim 2 wherein the second liquefaction is carried out in the absence of a supported catalyst, in the presence of sufficient molybdenum-containing organophosphorodithioate catalyst to yield at least 20 parts per million of molybdenum per part of first stage coal feedstock, and wherein the second liquefaction is conducted at an operating temperature of 800 degrees Fahrenheit or higher.

10. A two stage coal liquefaction process comprising the steps of:

reacting one part by weight of coal, at least two parts by weight of a liquefaction process-derived solvent, and a soluble molybdenum-containing organophosphorodithioate catalyst in a first stage reactor under liquefaction conditions at a temperature greater than about 800 degrees Fahrenheit to produce a partially liquefied reaction mixture, the soluble catalyst being present in a concentration sufficient to yield a molybdenum concentration of between 20 and 500 parts per million of molybdenum per part of first stage coal feedstock;

transferring the reaction mixture to a second stage reactor; and reacting the partially liquefied reaction mixture in the second stage reactor under liquefaction conditions at a temperature less than about 800 degrees Fahrenheit and in the presence of a supported hydrocracking catalyst to further liquefy and upgrade the mixture.

11. The process of claim 10 wherein the partially liquefied product is passed through an interstage separator to remove volatile reaction products.

12. The process of claim 10 wherein the soluble catalyst is a sulfurized oxymolybdenum phosphorodithioate catalyst.

13. The process of claim 10 wherein the weight ratio of hydrocracking catalyst to partially liquefied reaction mixture in the second stage reactor is from about 0.05 to about 0.50.

14. The process of claim 10 further comprising the steps of:

slurrying together the coal and the process-derived solvent in a slurry tank;

transferring the slurry to a preheater through a slurry transfer line;

introducing the soluble catalyst into the slurry transfer line downstream of the slurry tank and upstream of the preheater;

heating the slurry and catalyst to between about 600 to 750 degrees Fahrenheit in the preheater; and introducing the heated slurry and catalyst into the first stage reactor.

15. A two stage coal liquefaction process comprising the steps of:

reacting one part by weight of coal, at least two parts by weight of a process-derived solvent, and a soluble molybdenum-containing organophosphorodithioate catalyst in a first stage reactor under liquefaction conditions at a temperature greater than about 800 degrees Fahrenheit to produce a partially liquefied reaction mixture, the soluble catalyst being present in a concentration sufficient to yield a molybdenum concentration of between 20 and 1000 parts per million of molybdenum per part of first stage coal feedstock;

transferring the reaction mixture to a second stage reactor; and reacting the partially liquefied reaction mixture in the second stage reactor under liquefaction conditions at a temperature greater than about 800 degrees Fahrenheit and in the absence of a supported catalyst to further liquefy the mixture.

16. The process of claim 15 wherein the second stage reacting step is carried out in the presence of between about 20 to 1000 parts per million of molybdenum per part of first stage coal feedstock.

17. The process of claim 15 wherein an operating temperature of the first reactor is at least about 820 degrees Fahrenheit, and wherein an operating temperature of the second reactor is at least about 820 degrees Fahrenheit.

18. The process of claim 15 further comprising the steps of:

slurrying together the coal and the process-derived solvent in a slurry tank;

transferring the slurry to a preheater through a slurry transfer line;

introducing the soluble catalyst into the slurry transfer line downstream of the slurry tank and upstream of the preheater;

heating the slurry and catalyst to between about 600 to 750 degrees Fahrenheit in the preheater; and introducing the heated slurry and catalyst into the first stage reactor.

19. The process of claim 15 wherein the soluble catalyst is a sulfurized oxymolybdenum phosphorodithioate catalyst.

20. The process of claim 15 wherein the soluble catalyst is a sulfurized oxymolybdenum dialkylphosphorodithioate catalyst.

* * * * *